United States Patent [19]

Niimi et al.

[11] Patent Number: 4,793,970

[45] Date of Patent: Dec. 27, 1988

[54] HEAT-RESISTANT, CORROSION-RESISTANT NICKEL BASE ALLOYS

[76] Inventors: Itaru Niimi, 4-1205 Aza Obasama, Oaza Takahari Idaka-cho, Ohigusa-ku, Nagoya-shi, Aichi-ken; Kametaro Hashimoto, 29, 5-chome, Takami-cho, Toyota-shi, Aichi-ken; Masamitsu Noguchi, 10, Toyota-cho, Toyota-shi, Aichi-ken; Tadaoki Arakawa, 8,Toyota-cho, Toyota-shi, Aichi-ken; Taizo Suzuki, 5-33, Ote-machi, Sendai-shi, Miyagi-ken; Kunio Imada, 17, Kadota, Odaka-cho, Midori-ku, Nagoya-shi, Aichi-ken, all of Japan

[21] Appl. No.: 40,089

[22] Filed: May 17, 1979

Related U.S. Application Data

[63] Continuation of Ser. No. 859,598, Dec. 12, 1977, abandoned, which is a continuation of Ser. No. 698,789, Jun. 22, 1976, abandoned, which is a continuation of Ser. No. 547,409, Feb. 6, 1975, abandoned.

[30] Foreign Application Priority Data

Feb. 9, 1974 [JP] Japan ..... 49-16711

[51] Int. Cl.[4] ..... C22C 19/05

[52] U.S. Cl. ..... 420/447

[58] Field of Search ..... 75/171; 148/32, 32.5, 148/410, 428; 420/447

[56] References Cited

U.S. PATENT DOCUMENTS 2,570,193 10/1951 Bieber et al. ..... 75/171

*Primary Examiner*—R. Dean

[57] ABSTRACT

The present disclosure relates to heat-resistant, corrosion-resistant alloys to be used as materials for the exhaust valve of an internal combustion engine which contain specified amounts of C, Cr, Co, Fe, Ti, Al, Nb, and Ta.

1 Claim, 6 Drawing Sheets

FIG. 1a
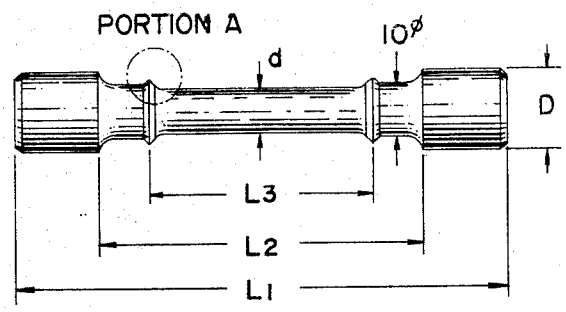
FIG. 1b
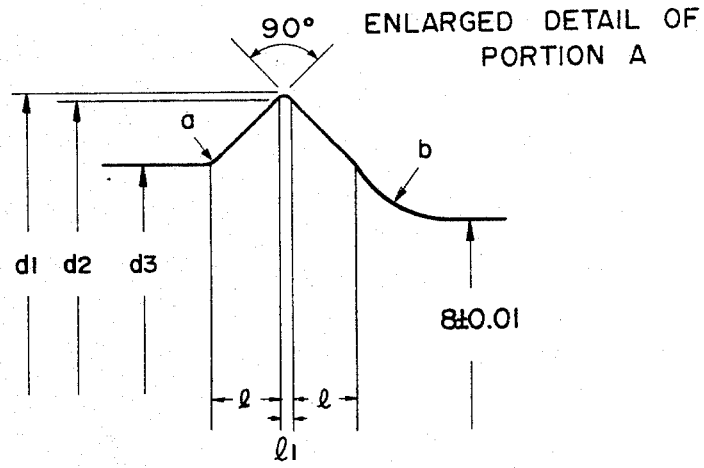
FIG. 1
SHAPE AND SIZE OF CREEP TEST PIECE

RESULT OF CREEP TEST

RESULT OF CREEP TEST

HIGH TEMPERATURE HARDNESS

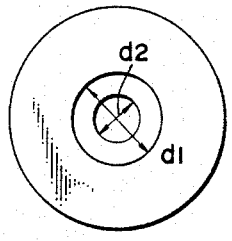
FIG. 5a
FIG. 5b
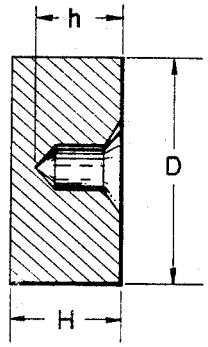
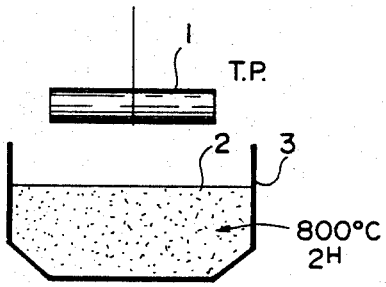
FIG. 7

HEAT-RESISTANT, CORROSION-RESISTANT NICKEL BASE ALLOYS

This is a continuation of application Ser. No. 859,598, filed Dec. 12, 1977, abandoned; which was a streamline continuation of Ser. No. 698,789, filed June 22, 1976, abandoned; which was a streamline continuation of Ser. No. 547,409, filed Feb. 6, 1975, abandoned.

BACKGROUND OF THE INVENTION

The exhaust valve of an internal combustion engine is exposed to hot corrosive exhaust gas at a temperature of more than about 800° C. and, in the course of use, the valve neck is subjected to strong tensile and bending stresses in seating because of the tension of the valve spring and the inertia of the valve itself. At the same time, the exhaust valve is oxidized at the above-mentioned high temperature by $CO_2$, $H_2O$ or residual $O_2$ in the exhaust gas and, in the case of a gasoline engine, it is also subjected to the hot corrosive action of the burned product of the lead compound which is added to the gasoline as an anti-knock agent. Moreover, impact wear takes place between the valve face and the valve seat during seating. These actions are aggravated in the case of an increased output or speed, so in designing an engine with high reliability and high speed, it is necessary to select a superior material for the exhaust valve.

At present the preferred material, both in Japan and abroad, for the internal combustion engine is 21-4N steel (Fe-0.5C-21Cr-4-Ni-9Mn-0.4N), but in view of the rigorous conditions under which the latest high performance engines operate, a valve steel having a greater high-temperature strength, resistance to oxidation and resistance to corrosion by lead oxide has to be developed. To meet this demand, there is an increasing tendency to build up an exhaust valve with stellite, but such a buildup operation is so complicated, requiring a number of steps, that it is economically disadvantageous; and particularly in the case of an engine subject to a heavy load the exhaust valve thus built up is unstable in performance.

Recently unleaded gasoline has come into use mainly in U.S. and Japan and regarding so called valve seat recession problem valve seat insertion is often resorted to as a remedy, but in that case the exhaust valve is exposed to a still higher temperature than before through valve seat insertion. Therefore it is necessary to increase still further the high-temperature strength and the resistance to hot corrosion of the exhaust valve. Furthermore, when a high-lead gasoline is used as has lately occurred abroad, an exhaust valve material having a still greater resistance to corrosion by lead oxide is necessitated.

SUMMARY OF THE INVENTION

The object of the present invention is to provide a nickel base alloy available as a material for use in making the exhaust valve of an internal combustion engine, which excels especially in the heat-resistance and corrosion-resistance required of an exhaust valve and is relatively easy to melt.

DETAILED DESCRIPTION OF THE INVENTION

In view of the above situation, the present inventors have arrived at the present invention through various studies seeking excellent materials for use in making an exhaust valve.

The alloys according to the present invention are a nickel base alloy composed of:

C less than 0.05%, Cr 19–21%, Co 1–10%, Fe 5–18%, Ti more than 0.8%, Al more than 0.8%, (Ti+Al being 1.6–5%) and the balance being Ni and impurities.

The alloys according to the present invention require no complicated step such as in the conventional stellite buildup; they permit the same upset forging as the conventional 21-4N steel; they are relatively cheap and can yield a valve with qualities superior to those of a conventional stellite-builtup valve. Furthermore, an exhaust valve made from a conventional 21-4N steel lacks high-temperature strength and resistance to high-temperature corrosion by lead oxide when a heavily leaded gasoline is used. While a stellite-builtup valve excels one made of 21-4N steel in durability, stellite, buildup consumes much expensive Co and requires more manpower, resulting in poor efficiency and high product cost. By contrast, the alloys according to the present invention are characterized by far better properties such as relative ease in melting, superior resistance to heat and corrosion and superior durability.

The alloys according to the present invention are not only suitable as materials for the suction and exhaust valves of an internal combustion engine, but also suitable as materials for various parts of machines and parts of gas turbines which call for resistance to high temperature oxidation, resistance to lead oxide, high-temperature strength and high-temperature hardness.

Next, the reasons for limitations in various components of the alloys according to the present invention are explained.

C in part forms a solid solution which contributes to the strength of matrix and in part forms a carbide, but too large a C content impairs the quality of the material by decreasing the resistance to high-temperature corrosion and decreasing the percentages of Ti and Nb etc. which are effective for $r^1$ phase precipitation. Thus C is required to be limited to a maximum of 0.05%.

Cr, being an indispensable element to ensure resistance to heat and to high temperature corrosion (to oxidation and to lead oxide), must constitute more than 19% of the alloy, but too much of it will seriously decrease hot-machinability. Thus it is advisable to limit the Cr content to less than 21%.

Co, like Ni, has the effect of stabilizing the austenite in the matrix and suppressing the diffusion of elements in the alloys, thereby contributing to the high-temperature strength, high-temperature hardness and resistance to lead oxide, but too much of it is likely to decrease the forgeability and machinability. Thus the optimum range for the Co content is 1–3%, but can be as high as 10%, as previously stated.

Ti, Al, and Nb, which combine with Ni to produce an intermetallic compound of $r^1$ phase [$Ni_3$ (Ti, Al, Nb)], thereby contributing to the high-temperature strength and high-temperature hardness of the alloys according to the present invention, should constitute, when taken together, over 4% of the alloy, but too much of them will seriously decrease the hot-forgeability. Thus the Ti, Al and Nb (partially Ta) content should be limited to less than 5%. It is desirable that, as single components, Ti 2.5–3.5%, Al 1.2–1.6%, Nb+Ta 0.3–0.5%. Further, Nb has an improved forgeability effect.

Fe is effective in cutting down the cost of nickel base alloys as well as in improving their forgeability and machinability, but an iron content of more than 13% or less than 11% will seriously decrease effect of high temperature creep strength. Thus the optimum range for the iron content is 11–13%.

The alloys according to the present invention, being based on Ni, with specified additions of the above-mentioned elements, have a matrix of austenitic structure containing $r^1$ phase (intermetallic compound) finely precipitated and diffused therein and are characterized by an excellent high temperature strength and resistance to corrosion.

The contents of Si and Mn are not specifically limited but these elements may be present within limits such that the properties of the alloy according to the present invention are not markedly affected thereby; and inclusion of minor impurities may be tolerated.

Next the alloys according to the present invention will be illustrated by several specific embodiments.

Table 1 gives the chemical compositions of the alloys according to the present invention and certain other alloys while Table 2 compares the properties of these alloys.

TABLE 1 (1)

| Alloys according to the invention | Composition C | Cr | Ni | Co | Fe | Ti | Al | Nb + Ta | Mo | Remarks |
|---|---|---|---|---|---|---|---|---|---|---|
| A | 0.015 | 20.13 | Bal | 1.7 | 12.96 | 2.55 | 1.55 | 0.50 | | (Note) |
| B | 0.02 | 20.8 | Bal | 2.8 | 12.01 | 2.9 | 1.41 | 0.31 | | The amount of Ta |
| C | 0.048 | 19.12 | Bal | 1.1 | 11.02 | 3.1 | 1.48 | 0.35 | | is less than 1/5 |
| D | 0.030 | 20.05 | Bal | 1.9 | 11.8 | 3.5 | 1.21 | 0.41 | | of Nb amount. |
| E | 0.038 | 20.22 | Bal | 2.9 | 11.08 | 3.1 | 1.57 | 0.31 | | |
| F | 0.013 | 20.92 | Bal | 2.7 | 12.90 | 2.9 | 1.29 | 0.38 | | |

TABLE 1 (2)

| Other alloys | Composition C | Cr | Ni | Co | Fe | Ti | Al | Nb + Ta | Mo | | | | | |
|---|---|---|---|---|---|---|---|---|---|---|---|---|---|---|
| Conventional | 0.47 | 20.73 | 3.71 | — | Bal | — | — | Nb | 0.14 | Si | Mn | W | V | N |
| alloy G | | | | | | | | 0.05 | | 0.13 | 8.70 | 0.16 | 0.10 | 0.37 |
| Stellite | 0.74 | 28.0 | — | Bal | — | — | — | — | — | W | | | | |
| No. 6 H | | | | | | | | | | 4.1 | | | | |

TABLE 1 (3)

| Test alloys | Composition C | Cr | Ni | Co | Fe | Ti | Al | Nb + Ta | Mo |
|---|---|---|---|---|---|---|---|---|---|
| I | 0.027 | 20.46 | Bal | 1.93 | 8.3 | 2.52 | 1.36 | 0.38 | |
| J | 0.047 | 20.86 | Bal | 2.80 | 10.2 | 2.62 | 1.22 | 0.44 | |
| K | 0.016 | 19.88 | Bal | 2.85 | 13.9 | 2.64 | 1.00 | 0.35 | |
| L | 0.05 | 20.18 | Bal | 2.75 | 16.2 | 2.70 | 1.25 | 0.32 | |
| M | 0.04 | 19.66 | Bal | 4.71 | 11.80 | 2.32 | 1.08 | 0.25 | |
| N | 0.019 | 20.39 | Bal | 4.78 | 11.92 | 2.53 | 1.28 | — | 1.39 |
| O | 0.032 | 21.51 | Bal | 3.20 | 12.60 | 2.51 | 1.28 | 0.30 | 0.62 |

BRIEF DESCRIPTION OF THE DRAWINGS

FIG. 1*a* is a side view of a test piece for creeping test.

FIG. 1*b* is an enlarged view showing the essential part of the test piece in FIG. 1*a*.

FIGS. 5*a, b* are respectively a plan view and a section view of a high temperature hardness test piece.

FIG. 7 is a diagram illustrating the procedure of corrosion test.

When an exhaust valve is fabricated of alloys which lack in high temperature strength, particularly in high temperature creep strength or are characterized by over-aging, such a valve is liable to develop a cupping or dishing plastic deformation of its umbrella part while working long time in an internal combustion engine.

Recently such dishing troubles with fast auto engines are occasionally reported and in this connection stand endurance tests of exhaust valves fabricated of the invented alloy, a control alloy G and test alloys (Fe over 14% and below 10%) as assembled in engines have been performed under rigorous conditions to check the possibility of dishing trouble.

Stand endurance test conditions

Engine displacement, four-cylinder 2000 cc;
running conditions, 5500 rpm × total load (W.O.T.) × 300 H,
water temperature 110° C., oil temperature 120° C.
(It is confirmed that under these conditions the umbrella part of an exhaust valve attains a maximum temperature of 850°–900° C.)

Figure 6:
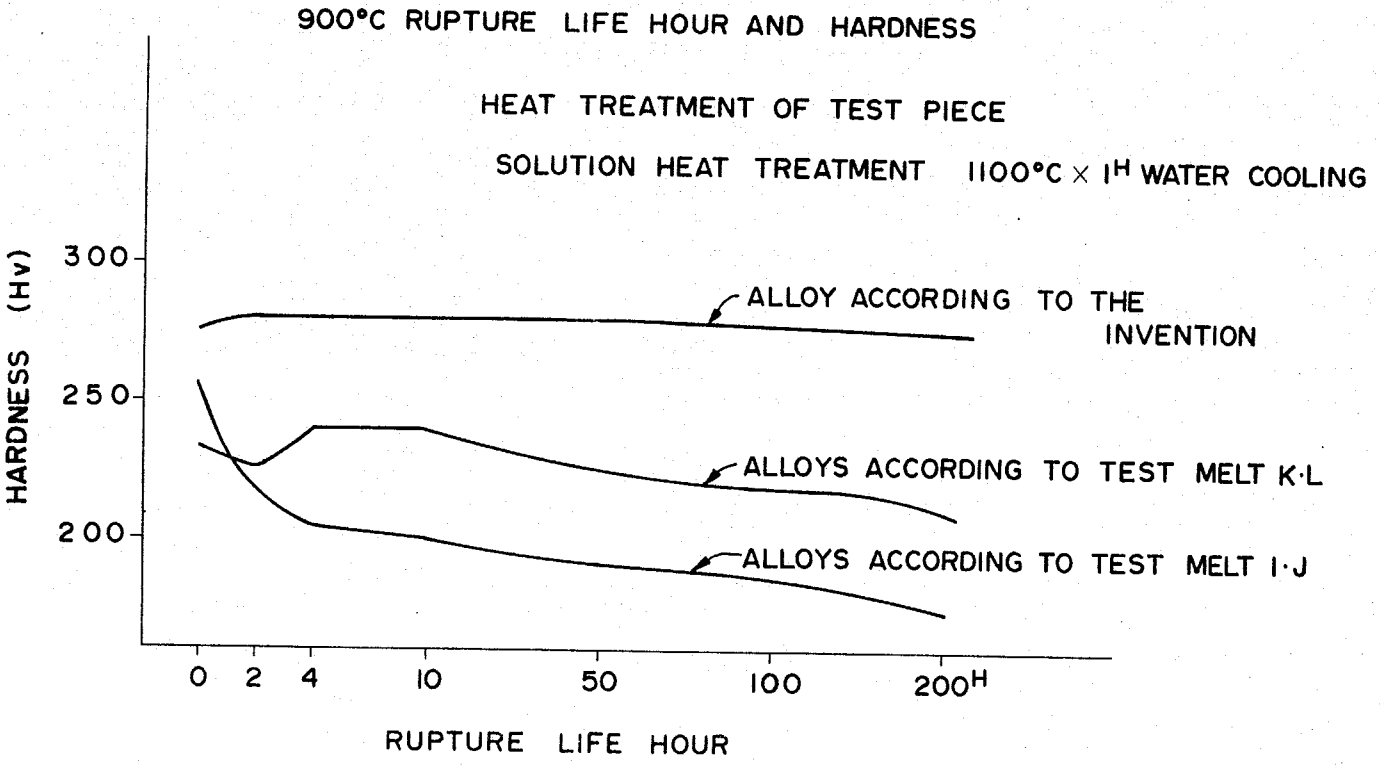
FIG. 6 shows diagrams illustrating the profiles of an exhaust valve before and after testing.

The results have shown that after testing the exhaust valves fabricated of the control alloy (A) and test alloy (Fe over 14% and below 10%) suffered a deformation of the umbrella part as illustrated in FIG. 6, the displacement due to dishing amounting to a maximum of 0.4–0.6 mm; but the exhaust valve fabricated of the invented alloy developed no dishing, testifying to its ample durability.

The difference in development of dishing among the invented alloy, the control alloy and the test alloys is apparent also from a clear difference recognized as described later, in high temperature creep strength, age hardening, high temperature hardness and other characteristics among them.

The invented alloy is found far superior to the control alloy and the test alloys in all respects, i.e., 100 H and 200 H repture strengths in high temperature creep test, (2) stress under which the total creep strain amounts to 0.5% in 200 H, (3) high temperature age hardening, and (4) high temperature hardness.

Even from these results, it is obvious that the invented alloy has excellent properties and makes a valuable material for high performance exhaust valve.

High temperature creap strength

Procedure of creeping test

The testing machine used was a single creep tester, upright, 3-ton capacity, of signle lever type with lever ratio 1:10. The profile of a test piece is shown in FIG. 1.

FIG. 1*a* is a side view showing a whole piece.

FIG. 1*b* is an enlarged view of the part A in FIG. 1*a*. In the figures, $L_1$ is 88 mm; $L_2$ is 58 mm; $L_3$ is 40±0.05 mm; d is 8±0.1 mm; $\theta$ is 90°; $d_1$ is 12.5$\theta$; $d_2$ is 12.3$\theta$; $d_3$ is 10$\theta$; l is 1.15; $l_1$ is 0.2 mm; a is 0.5R; and b is 1R.

Figure 2:
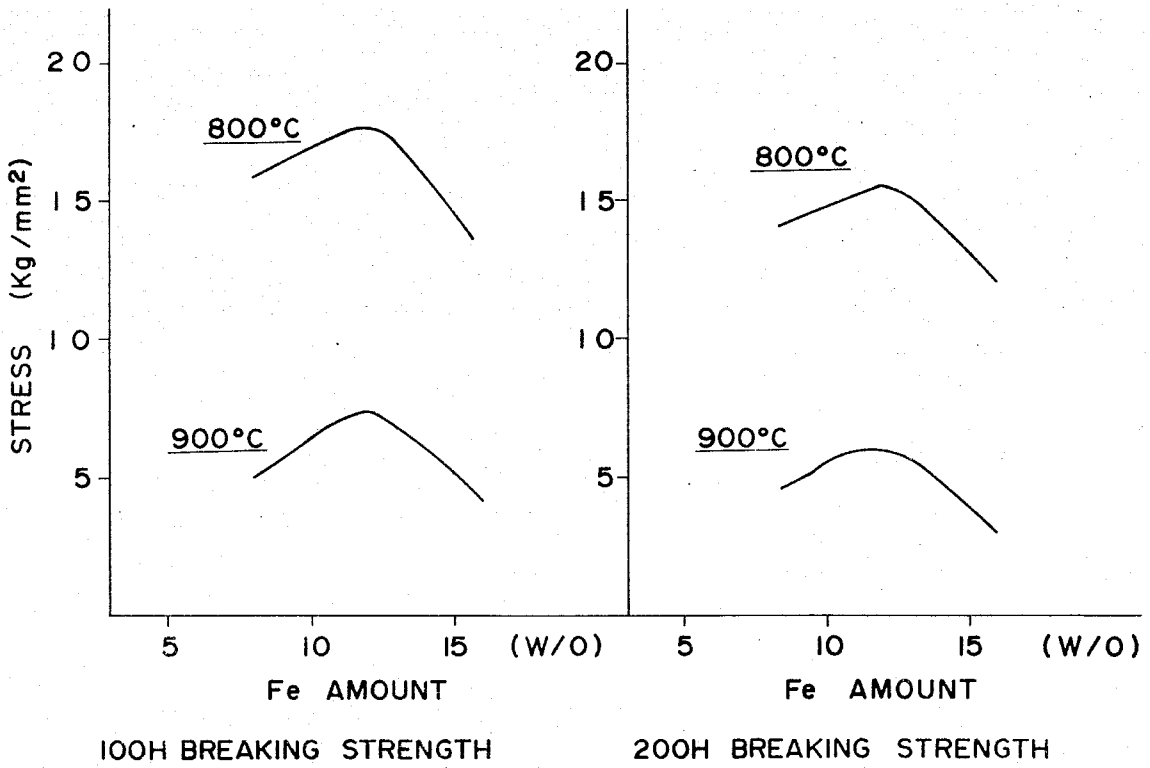
FIGS. 2 and 3 are diagrams summarizing the results of creeping test.
Figure 3:
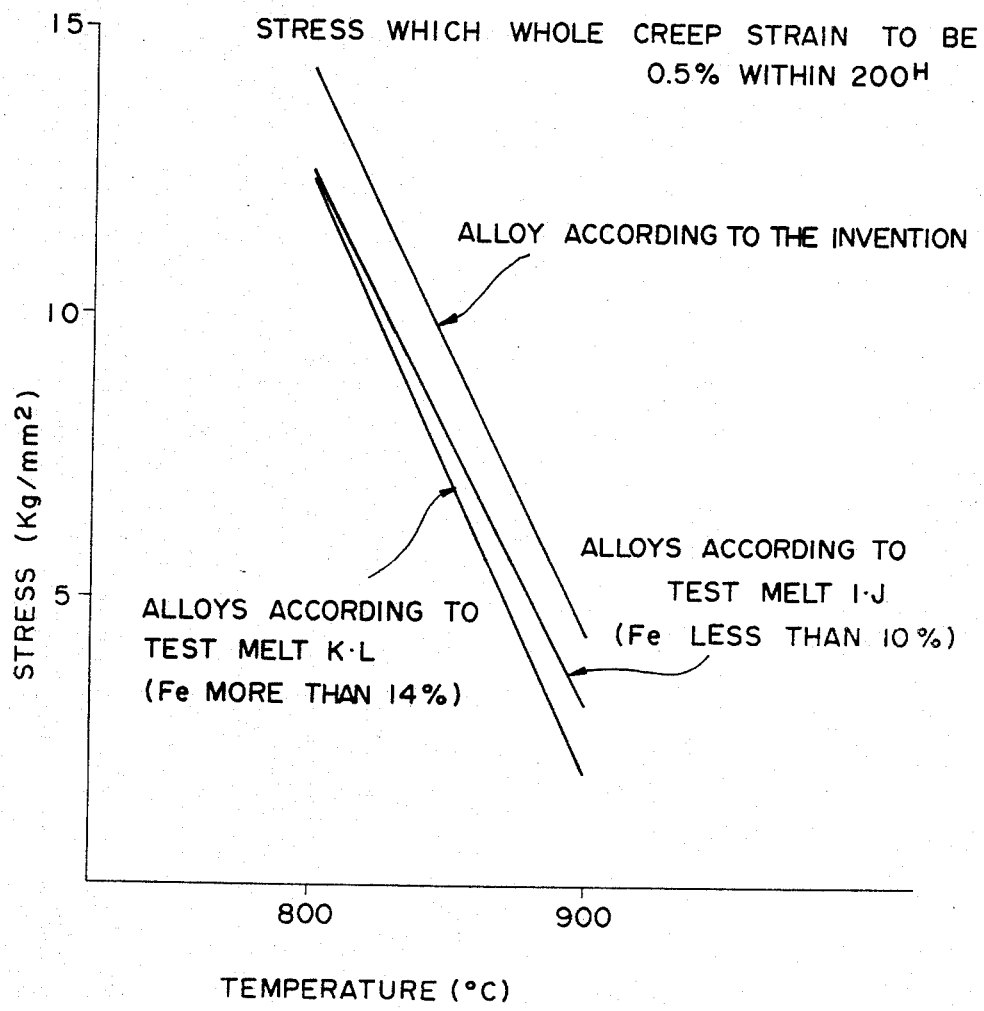

To determine the elongation, the distance between the flanges at both ends of a parallel part of the test piece was measured to an accuracy of 1/1000 mm. The results of creeping tests at 800° C. and 900° C. are illustrated in FIGS. 2 and 3, which show (1) 100 H and 200 H rupture strengths and (2) stress under which the total creep strain amounts to 0.5% in 200 H.

From these results it is clear that the invented alloy excels in high temperature creep strength. This may be pointed out as a major reason why the valve fabricated of the invented alloy did not develop an umbrella dishing even after long endurance test of engine.

Figure 4:
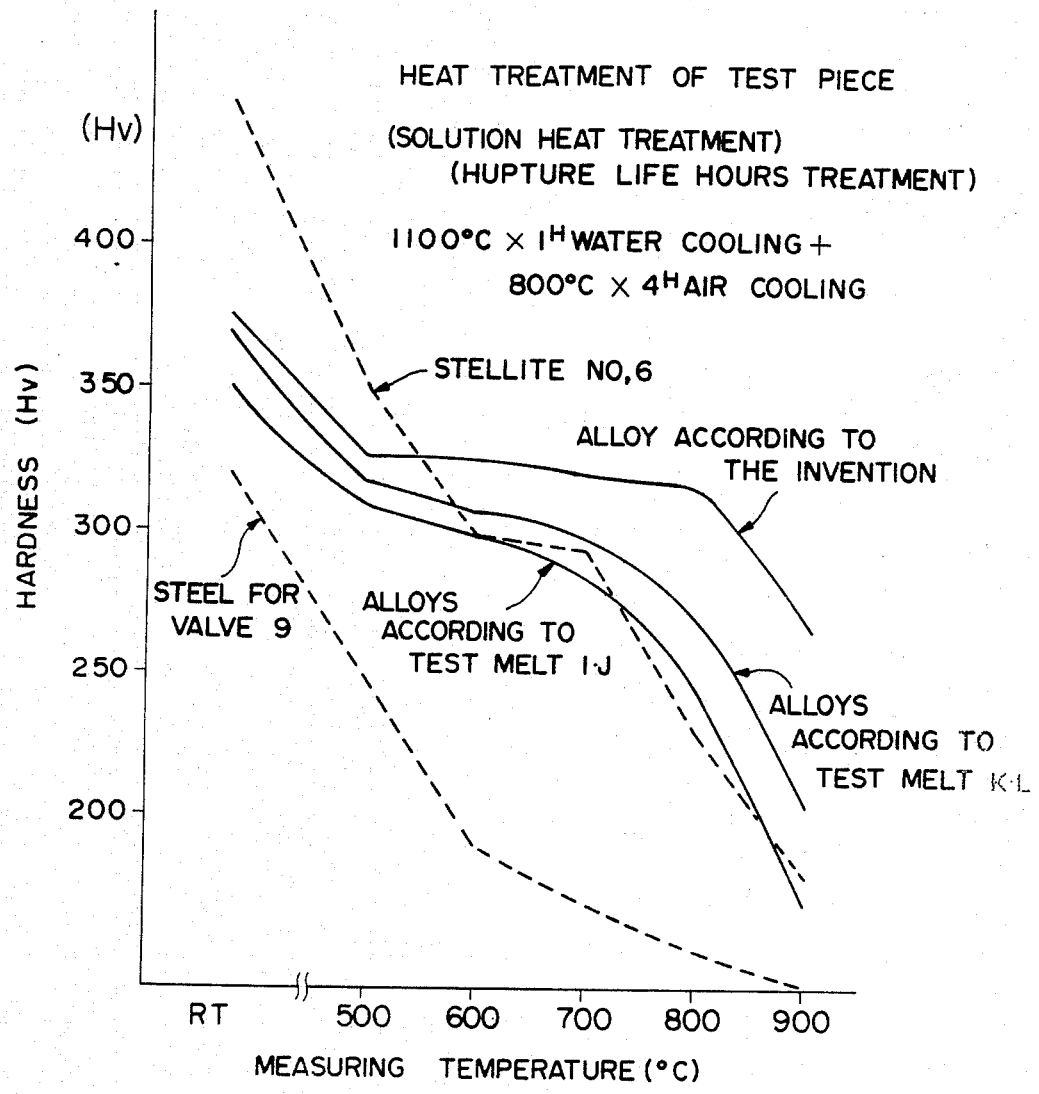
FIG. 4 is a diagram illustrating the relation between temperature and hardness.

As indicative of the high temperature strength characteristic of the invented alloy, the high temperature hardness at room temperature~900° C. is illustrated in FIG. 4, the profile of the test piece in this test being shown in FIG. 5.

With respect to high temperature hardness too, the invented alloy is found superior to the other test alloys; especially it is definitely far superior to the stellite No. 6 for mass production of exhaust valves and the control alloy A. Meanwhile observation of aging behaviour under long heating has revealed that the invented alloy retains the initial hardness, as seen from FIG. 6, even after aging treatment of 900° C.×200 H and it is practically free from over-aging.

Thus even from its excellence in high temperature hardness and no possibility of suffering over-aging at 900° C., the invented alloy is obviously far superior to any conventional alloy as material for high performance exhaust valve.

Corrosion resistance to lead oxide (lead oxide-corrosion test)

Attention has been paid in exhaust valves to their resistance to corrosion due to lead oxide.

After long run on high-doped gasoline (equivalent to USA commercial doped high-octance gasoline), an engine was disassembled and the deposits on the exhaust valve and on the wall of combustion chamber were sampled and put to chemical analysis. Based on the results of this analysis, synthetic ash composed of a lead oxide with chemical composition similar to that of the deposits of burnt products was prepared and using it, the results of corrosion tests were evaluated.

Testing procedure

Composition of synthetic ash and the contents of tests are given below.

| Synthetic ash (w/o) | | Test contents |
|---|---|---|
| PbO | 35 w/o | synthetic ash 100 g |
| $PbSO_4$ | 15 | placed in alumina crucible. |
| $PbCl_2$ | 35 | test piece 8 $\phi$ × 20 |
| $PbBr_2$ | 15 | test piece held 2 hours in atmosphere 30 mm above ash of 800° C. weight measured before and after test. |

To simulate the condition in the combustion chamber of engine, the test piece 1, as illustrated in FIG. 7, was suspended in the atmosphere over a crucible 3 holding synthetic ash.

The results are summarized in Table 2.

The invented alloy, with less corrosion loss, turned out remarkably better than the conventional valve steel and other test alloys. If the invented alloy is used for fabrication of exhaust valve, the corrosion resistance of the invented alloy to lead oxide will impart the valve with superior anti-corrosiveness.

TABLE 2

Results of lead oxide-corrosion tests

| | Alloys tested (Fe %) | Corrosion loss mg/cm$^2$ |
|---|---|---|
| Invented alloy | A (Fe 12.96%) | 10 |
| | B (Fe 12.01%) | 8 |
| | C (Fe 11.02%) | 10 |
| | D (Fe 11.8%) | 7 |
| | E (Fe 11.08%) | 7 |
| | F (Fe 12.70%) | 9 |
| Tentative alloy | G (Conventional valve steel) | 182 |
| | H (Stellite 6) | 40 |
| | I (Fe 8.3%) | 45 |
| | J (Fe 10.2%) | 36 |
| | K (Fe 13.7%) | 52 |
| | L (Fe 16.2%) | 63 |
| | M (Fe 11.8% Co 4.71%) | 8 |
| | N (1.39% Mo) | 420 |
| | O (0.60% Mo) | 330 |

Alloys with Fe over 14% or below 10% suffer great corrosion loss.

Trace addition of Mo increases corrosion loss.

What is claimed is:

1. Heat-resistance, high temperature lead oxide corrosion-resistant Ni-case alloy consisting essentially of:

C 0.02–0.04%, Cr 20.05–20.8%, CO 1.9–2.9%, Fe 11–12%, Ti 2.9–3.5%, Al 1.2–1.4%, Nb+Ta 0.3–0.4% (but the amount of Ta is 1/5 of Nb) where the total amount of Ti+Al+Nb+Ta is 4–5%, and the balance substantially all Ni and impurities.

* * * * *